US005458436A

United States Patent [19]

Plowman et al.

[11] Patent Number: 5,458,436

[45] Date of Patent: Oct. 17, 1995

[54] MODULAR DRAINAGE TUBE CONSTRUCTION SYSTEM

[75] Inventors: Jeffrey D. Plowman, Prinsburg; Arnold H. Plowman, Willmar, both of Minn.

[73] Assignee: Multi-Flow Tube, Inc., Prinsburg, Minn.

[21] Appl. No.: 267,650

[22] Filed: Jun. 29, 1994

[51] Int. Cl.[6] ..... E02B 11/00

[52] U.S. Cl. ..... 405/36; 405/43

[58] Field of Search ..... 405/36, 41, 43, 405/45, 49, 50, 51; 285/921, 150, 137.1, 202, 203, 158

[56] References Cited

U.S. PATENT DOCUMENTS

| | | | |
|---|---|---|---|
| 1,484,575 | 2/1924 | Shulin | 405/49 X |
| 1,760,314 | 5/1930 | Murrey | 405/51 |
| 3,830,373 | 8/1974 | Sixt et al. | 210/489 |
| 4,182,591 | 1/1980 | Stanelle | 414/291 |
| 4,572,700 | 2/1986 | Mantarro et al. | 404/35 |
| 4,622,138 | 11/1986 | Wagner | 210/170 |
| 4,639,165 | 1/1986 | Flecknoe-Brown | 405/45 |
| 4,678,367 | 7/1987 | Warner | 405/41 X |
| 4,904,113 | 2/1990 | Goddard et al. | 405/45 |
| 4,995,759 | 2/1991 | Plowman et al. | 405/43 |
| 5,222,831 | 6/1993 | Todd, Sr. et al. | 405/36 |

OTHER PUBLICATIONS

Advertising brochure published by Advanced Drainage Systems, Inc., "AdvanEDGE Pipe–a Drainage Pipe with a Difference," four pages.

*Primary Examiner*—Dennis L. Taylor
*Assistant Examiner*—Frederick L. Lagman
*Attorney, Agent, or Firm*—Gregory P. Kaihoi

[57] ABSTRACT

A modular junction fitting system for joining ends of two or more lengths of edge-type drainage robing (being of the type that is substantially taller than it is wide in transverse cross-section). The junction fitting of the invention includes a central generally vertically oriented tube that is substantially taller than it is wide, side walls having, for each edge-type drainage tube to be connected to such fitting, one or more orifices for permitting fluid communication of the drainage tubing with the interior of the central tube. A connector is provided for connecting the edge-type drainage tubing to the central vertical tube in alignment with the orifices. The system can utilize simple mechanical attachments between the drain tubing, the connector, and the central tube, permitting easy fabrication of a wide variety of fittings, thus permitting the system to be used in a wide variety of configurations.

24 Claims, 8 Drawing Sheets

MODULAR DRAINAGE TUBE CONSTRUCTION SYSTEM

TECHNICAL FIELD

The invention relates to drainage systems for use in draining unwanted water from areas of land such as roadways, golf courses, agricultural lands, athletic fields and the like.

BACKGROUND ART

In a variety of industrial and commercial settings it is necessary or desirable to provide soil drainage to remove unwanted water. For example, in agriculture fields or golf courses, low spots frequently are drained to prevent accumulation of excess moisture which, in the case of agricultural fields would inhibit crop growth and yields, and in the case of golf courses, would provide unsuitable playing conditions.

Road construction is another significant example. Moisture immediately beneath the pavement surface causes distresses of varying types which may rapidly destroy the pavement. In flexible pavement systems, distresses may be caused by either water alone or in combination with temperature variations. Such distresses include pot holes, loss of aggregates, raveling, weathering, alligator cracking, reflective cracking, shrinkage cracking, and heaving from repeated frost/thaw cycles and/or swelling soils. Rigid pavement systems distresses include faulting, joint failure, pumping, various types of cracking, blow-up or buckling, surface spalling, steel corrosion, and heaving from frost/thaw and/or swelling soils. These distresses are discussed in more detail in U.S. Pat. No. 4,572,700.

A variety of drainage systems have been employed over the years in attempts to provide economical drainage systems to accomplish desired drainage objectives. Early drainage systems comprised filling trenches with sand and coarse aggregates in place of indigenous soils less permeable to water, such as clay. An improvement on these systems utilized synthetic textile fabrics (geo-textiles) as a trench liner, filled with a coarse aggregate to support the fabric. Geo-textiles prevent the aggregate from clogging with silt, thereby defining a drainage passageway. More recently, round perforated corrugated tubing has been used, typically placed in an aggregate-filled trench, sometimes in combination with a geo-textile covering the perforated conduit. See, e.g., U.S. Pat. Nos. 3,830,373; 4,182,591; and 4,572,700.

As discussed in detail in U.S. Pat. No. 4,572,700, many of these prior art drainage systems are relatively expensive to install due to being labor-intensive, and/or requiring removal and replacement of relatively large volumes of indigenous soil with preferred aggregate and/or sand backfill, processes involving extensive transportation of soil and backfill. Other products, such as the drain strips shown in U.S. Pat. Nos. 4,639,165 and 4,572,700, intended to be less costly to install, are relatively fragile in their construction, and tend to not support the filter fabric adequately against soil pressures, particularly during backfilling.

U.S. Pat. No. 4,995,759 proposed a drainage tube construction falling in the class generally designated as "edge-type" drainage systems. This construction consists of several longitudinally extending parallel corrugated plastic (typically, e.g., polyethylene) tubes stacked upon one another to form a relatively tall, elongated edge drain product that is relatively narrow (in transverse cross-section), permitting it to be installed in relatively narrow trenches. This system (along with other relatively narrow edge-type drainage products) reduce the amount of indigenous soil which must be removed and the amount of backfill utilized in installing a drainage system.

While the drainage tube construction of U.S. Pat. No. 4,995,759, along with other edge-type drainage systems, can be manufactured relatively economically, it has been found that actual installations of such products desirably require a variety of different types of junctions between adjoining lengths of tubing. Each junction of a different type therefore requires the manufacture of a specialized fitting designed particularly for that type of junction. With a wide variety of possible types of drainage tubing installation configurations, a need has arisen for a wide variety of junction fittings. The cost of manufacturing molds for each type of fitting, however, can be significant-the unit volume demand for any one particular fitting is substantially less than demand for the drainage product itself, resulting in a relatively high per unit cost for the fittings in relation to the cost of the tubing. Moreover, as more applications for edge drain-type products are found, specialized fittings to facilitate such applications are often necessary. The economic viability of manufacture of such variety of fittings, however, poses a significant limit on the range of possible applications.

Accordingly, there is a need for an economical system of fittings for use with edge-type drain products generally, and for the particular edge-type drain product described in U.S. Pat. No. 4,995,759.

DISCLOSURE OF INVENTION

The invention provides a modular system of fittings which can be quickly and easily adapted to a wide variety of potential drainage applications. The modular system utilizes a few basic components which can be manufactured in greater volume and then utilized in relatively simple fabrication steps to create a wide variety of potential customized fittings, all on a very economical basis.

In one embodiment, the invention provides a junction fitting for joining the ends of two or more lengths of drainage tubing, at least one of which is a relatively narrow, elongated plastic edge-type drainage tubing of the type which, in transverse cross-section, is substantially taller than it is wide, with relatively thin walls. The junction fitting is comprised of a central housing having generally vertically oriented side walls and being substantially taller than it is wide, the side walls having, for each edge-type drainage tubing to be connected to such fitting, one or more orifices for permitting fluid communication of the drainage tubing with the interior of the central housing. Means is also provided for connecting the edge-type drainage tubing to the central housing in registration with these orifices.

When used in connection with the edge-type drainage tubing of U.S. Pat. No. 4,995,759, the housing side walls include, for each edge-type drainage tubing to be connected to the fitting, a set of vertically aligned orifices spaced from one another, each set of orifices including an individual orifice corresponding to each of the individual parallel tubes of such edge-type drainage tubing.

Preferably the vertically oriented tube of the junction fitting comprises a conventional round plastic (typically, e.g., PVC, ABS, or polyethylene) pipe which is readily commercially available. In one preferred embodiment, this pipe extends upwardly from the orifices to which the drainage tubing is connected, and includes a removable cap sealing the upper end of the tube and permitting access to the interior of the junction. In another embodiment, the junction fitting includes a conventional "el" fitting attached to the bottom of the vertical tube, thereby permitting connection of a conventional length of round plastic tubing to carry away from the junction water which has accumulated in the junction fitting.

Utilizing a single standardized tubular connector to connect the end of the length of the edge-type drain tubing to the orifices in the vertical tube of the junction fitting, junction fittings of a wide variety of configurations can be readily and economically fabricated for a wide variety of applications of the edge-type drain product.

BEST MODE FOR CARRYING OUT THE INVENTION

Figure 1:
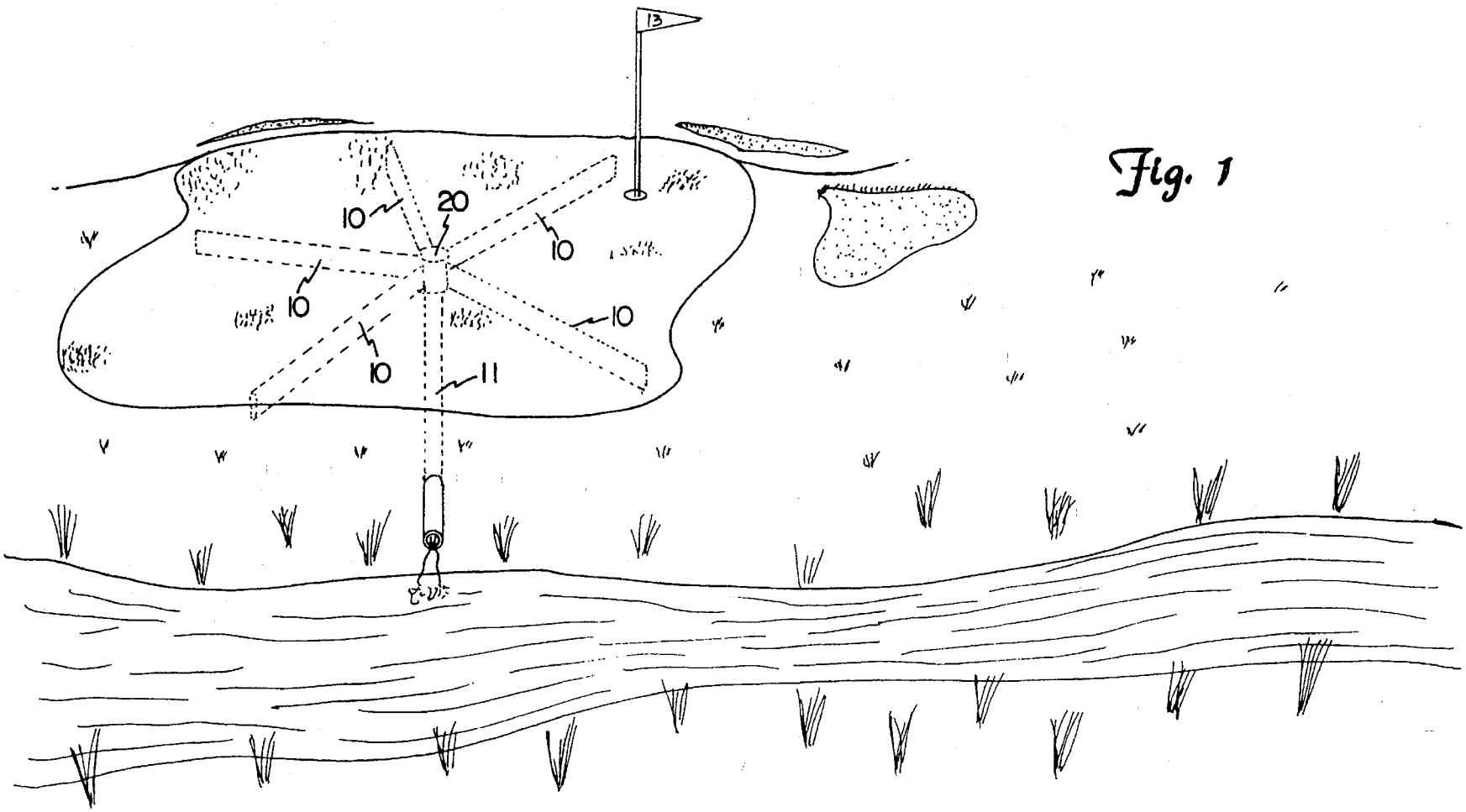
FIG. 1 is a schematic illustration of a customized installation of an edge-type drain product utilizing the junction fitting of the invention to drain a green on a golf course.

The modular drainage tube construction system of the invention is useful in a variety of contexts where it is desirable to drain excess water from the soil. Examples include agricultural fields, athletic fields, golf courses, road beds, and the like. FIG. 1 illustrates a particular application in connection with a golf course where it is desired to provide drainage beneath a green. A modular drainage robe construction system is depicted somewhat schematically as installed beneath the green, the system including five lengths of a plastic edge-type drain tubing 10 (each such length of robing being characterized in that it is substantially taller than it is wide, in transverse cross-section) connected to a central junction fitting 20. In this application, the lengths of edge drain tubing 10 extending outward from the junction fitting 20 like spokes in a wheel. Water collected in these lengths of edge drain tubing therefore drains into the central junction fitting, and from them into a preferably round drain tube 11 connected to the bottom of the junction fitting 20. The round drain robe 11 then carries the water off to a suitable discharge location, such as a nearby stream.

Figure 2:
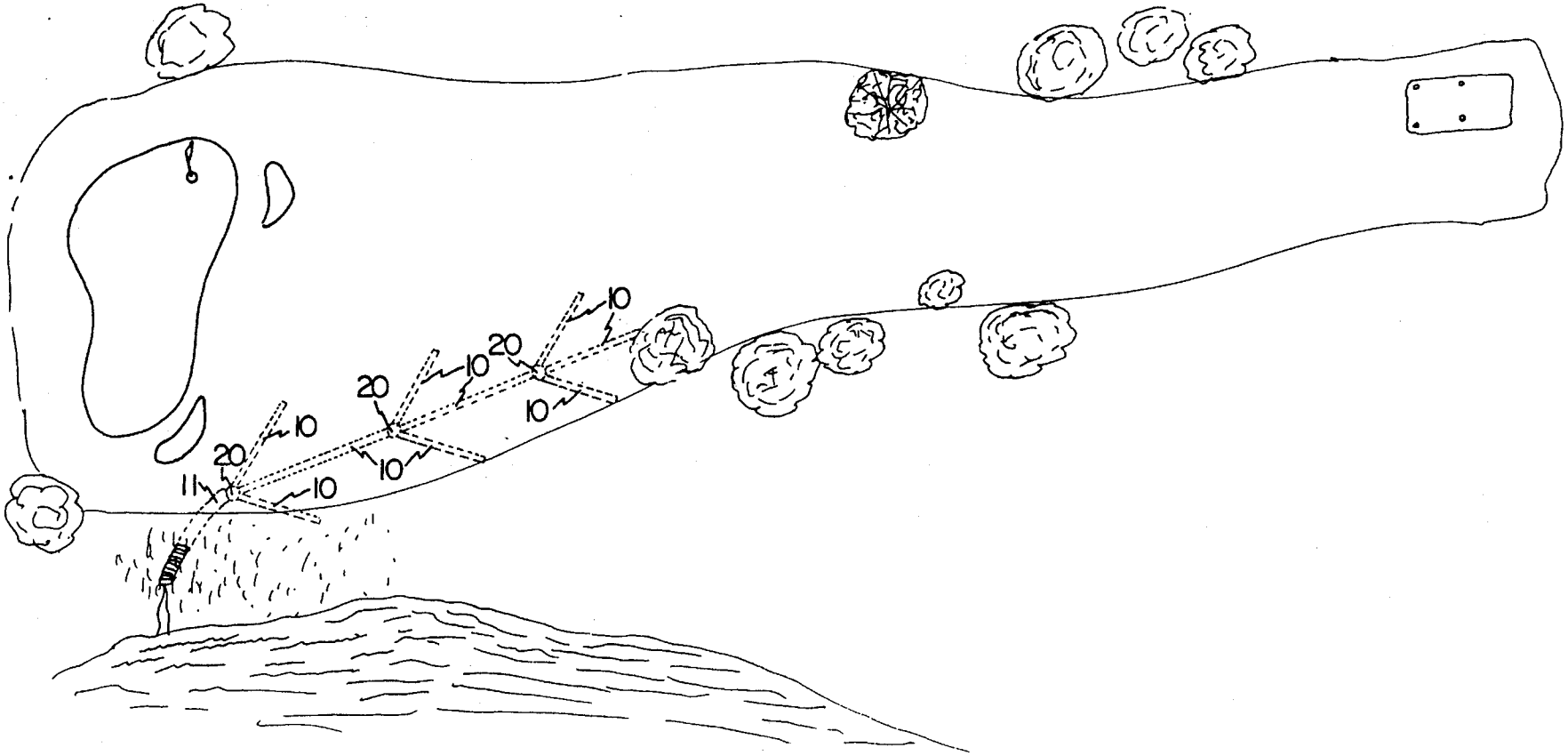
FIG. 2 is a similar schematic view of an edge drain system utilizing the junction rifling of the invention in an installation along the edge of a fairway of a golf course.

FIG. 2 depicts another type of installation in a golf course. Here, it is desired to drain a portion of the fairway (e.g., a low-lying portion). In this application, a herringbone pattern of edge-type drain tubing lengths 10 are installed in the ground, these lengths being joined by junction fittings 20 at appropriate locations. The left-most junction fitting 20 in FIG. 2 in turn is connected to a preferably round drain tube 11 which carries the collected water off to a discharge site.

FIGS. 1 and 2 illustrate only two of a wide variety of possible geometric configurations of lengths of edge drain tubing 10 that desirably are connected to drain excess water from a particular piece of land. These examples illustrate the need for a wide variety of junction fittings to accommodate these various configurations.

Figure 3:
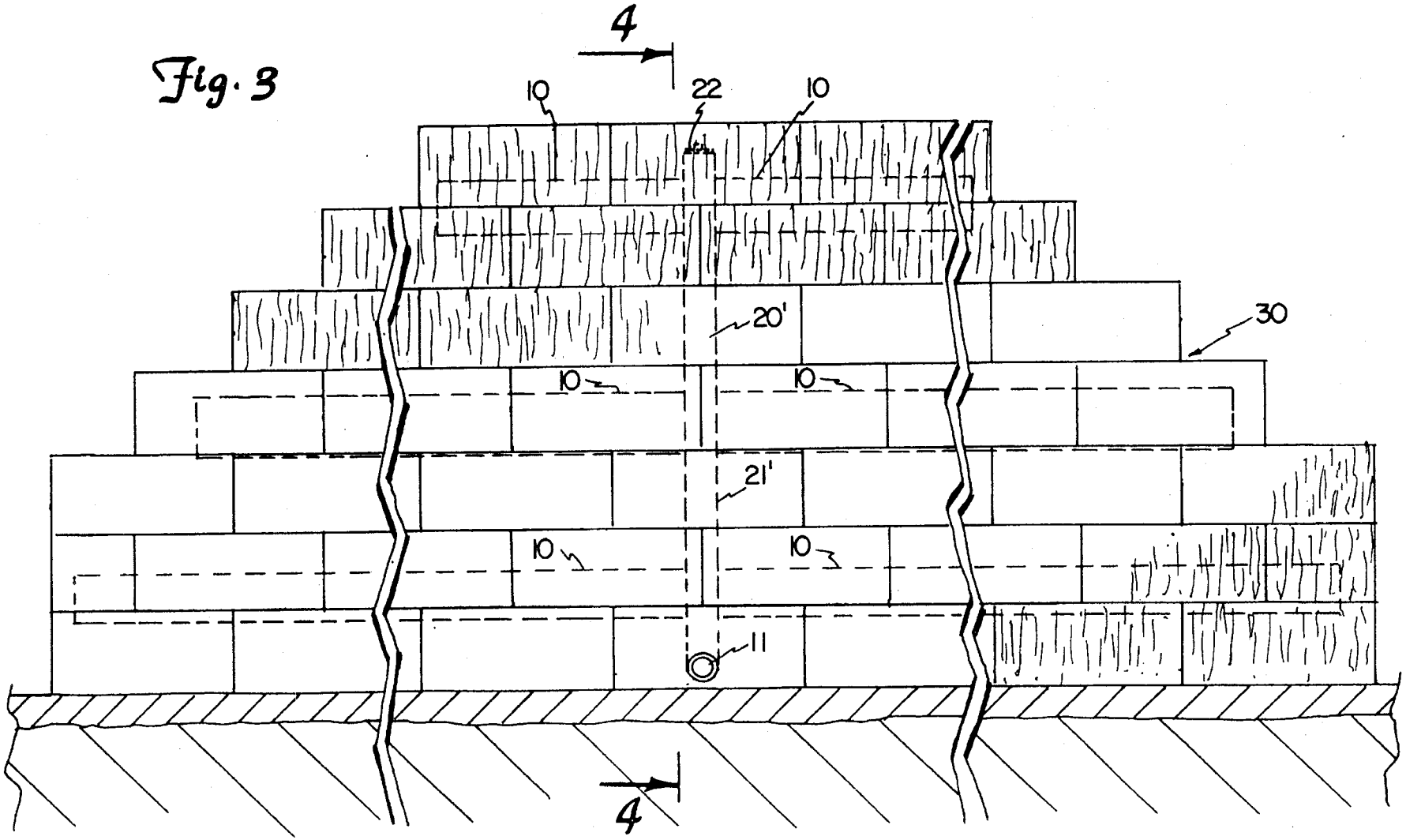
FIG. 3 is a partially broken-away elevational view of a retaining wall behind which mounted a customized edge-type drainage system utilizing the junction fitting system of the invention.
Figure 4:
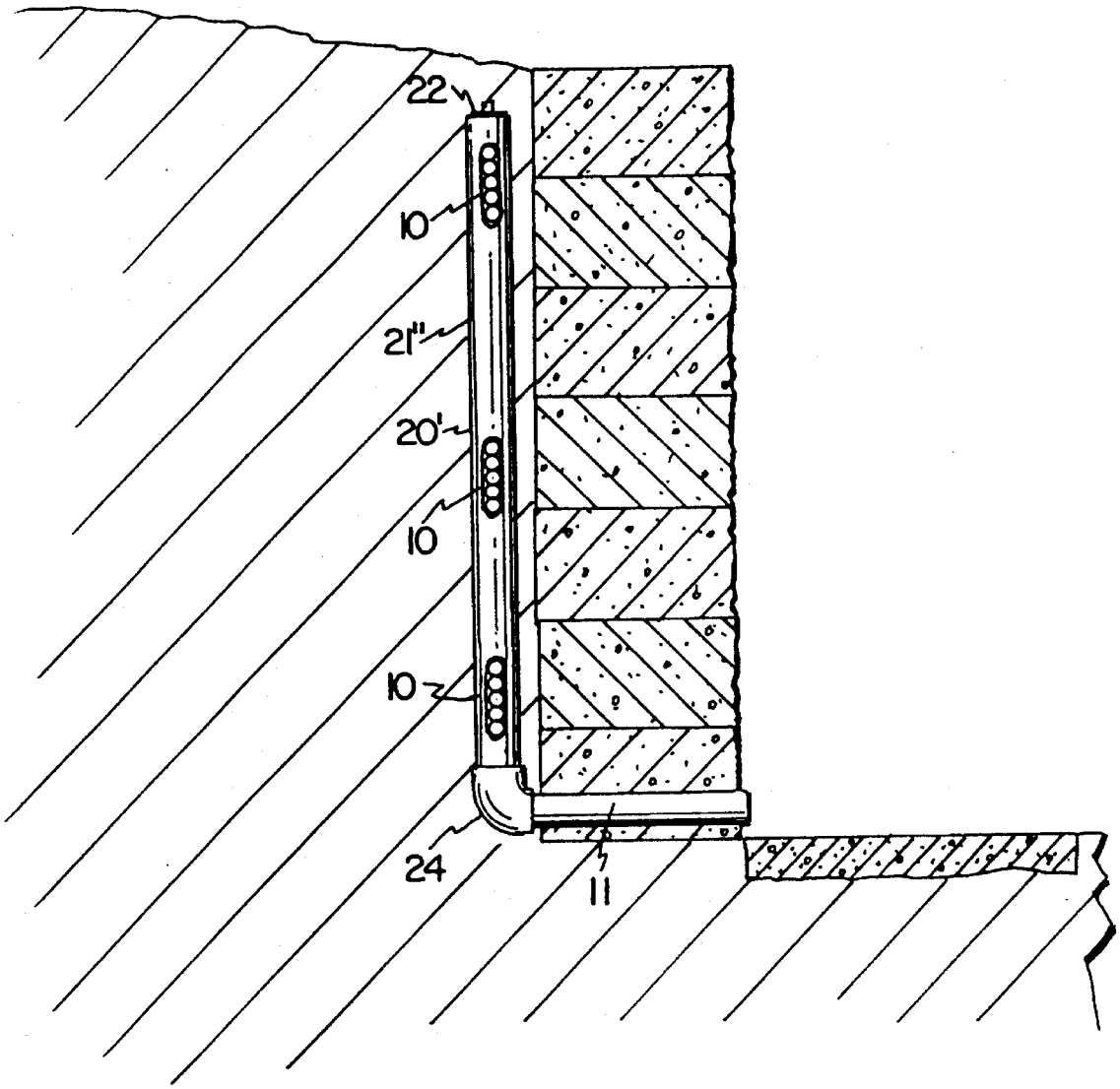
FIG. 4 is a cross-sectional view of FIG. 3 taken along line 4—4 thereof.

FIGS. 3 and 4 illustrate another application of the modular drainage tube construction system of the invention. In this drawing, a retaining wall 30 has been fitted with six separate lengths of an edge drain tubing 10, all of which are connected to a common junction fitting 21'. The junction fitting 20' includes a removable threaded cap 22 at its top end, and an "el" fitting 24 at its lower end, which in turn is connected to a round drain tube 11 extending through the base of the retaining wall 30. (See FIG. 4.)

Figure 5:
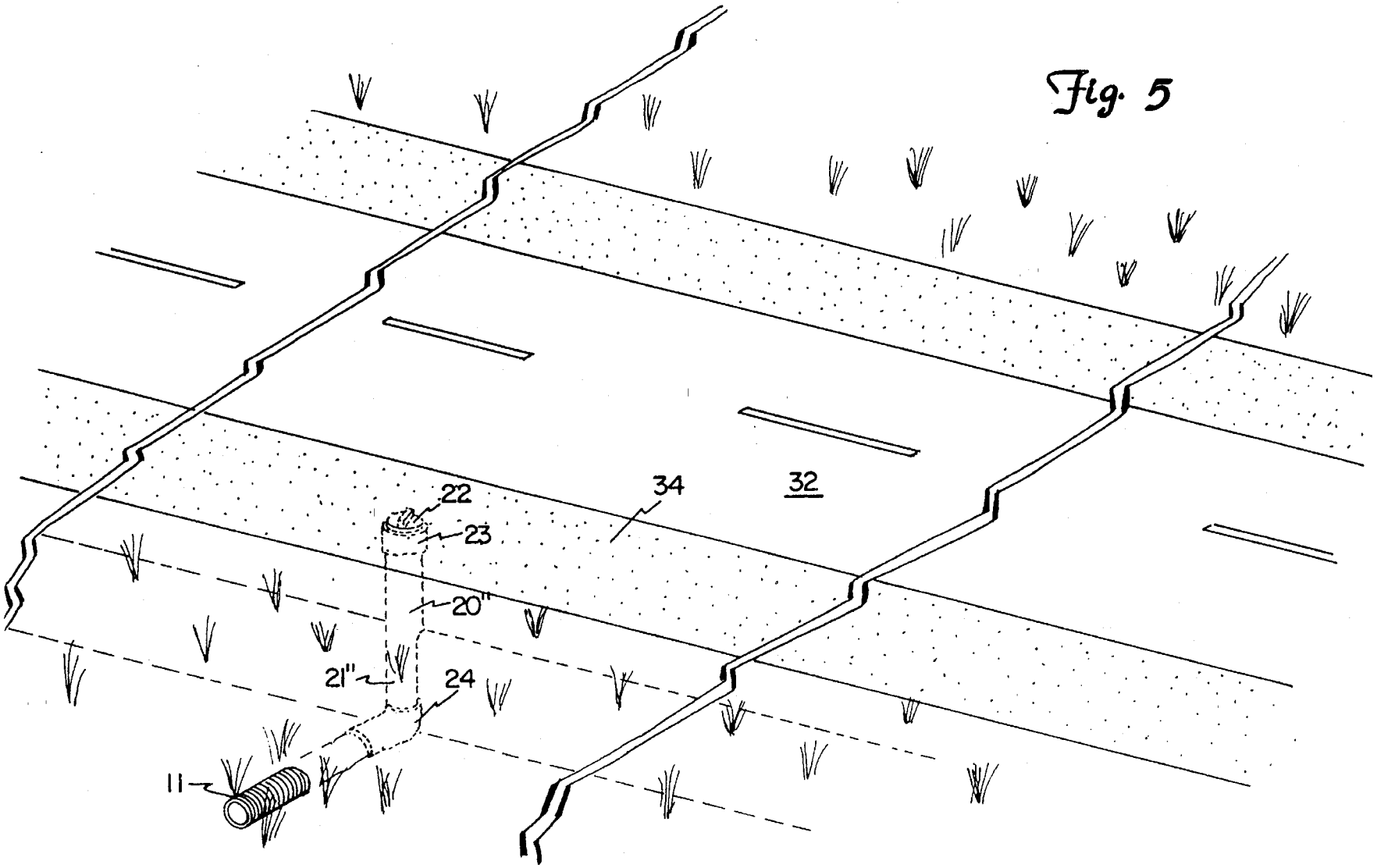
FIG. 5 is a perspective illustration of an edge-type drain product installed along the edge of a road bed using a customized junction fitting of the invention.

FIG. 5 illustrates yet a further application for the modular drainage tube construction system of the invention. In this application, the drainage tubing is installed along the edge of a road bed. Two lengths of edge-type drain tubing 10 are connected by a junction fitting 20". The junction fitting includes a removable top cap 22 preferably threadingly received in a threaded fitting 23. As illustrated in the drawing, the cap may be recessed slightly under the gravel of the shoulder 34 adjacent to the road bed surface 32, so that it is ordinarily not visible but can be easily accessed when desired (such as by using a metal detector to detect a metal cap). As with the retaining wall illustrated in FIGS. 3 and 4, the junction fitting 20" of FIG. 5 includes, at its lower end, an "el" fitting 24 connecting to a round drain tube 11 for carrying collected water away to a suitable discharge site.

Figure 6:
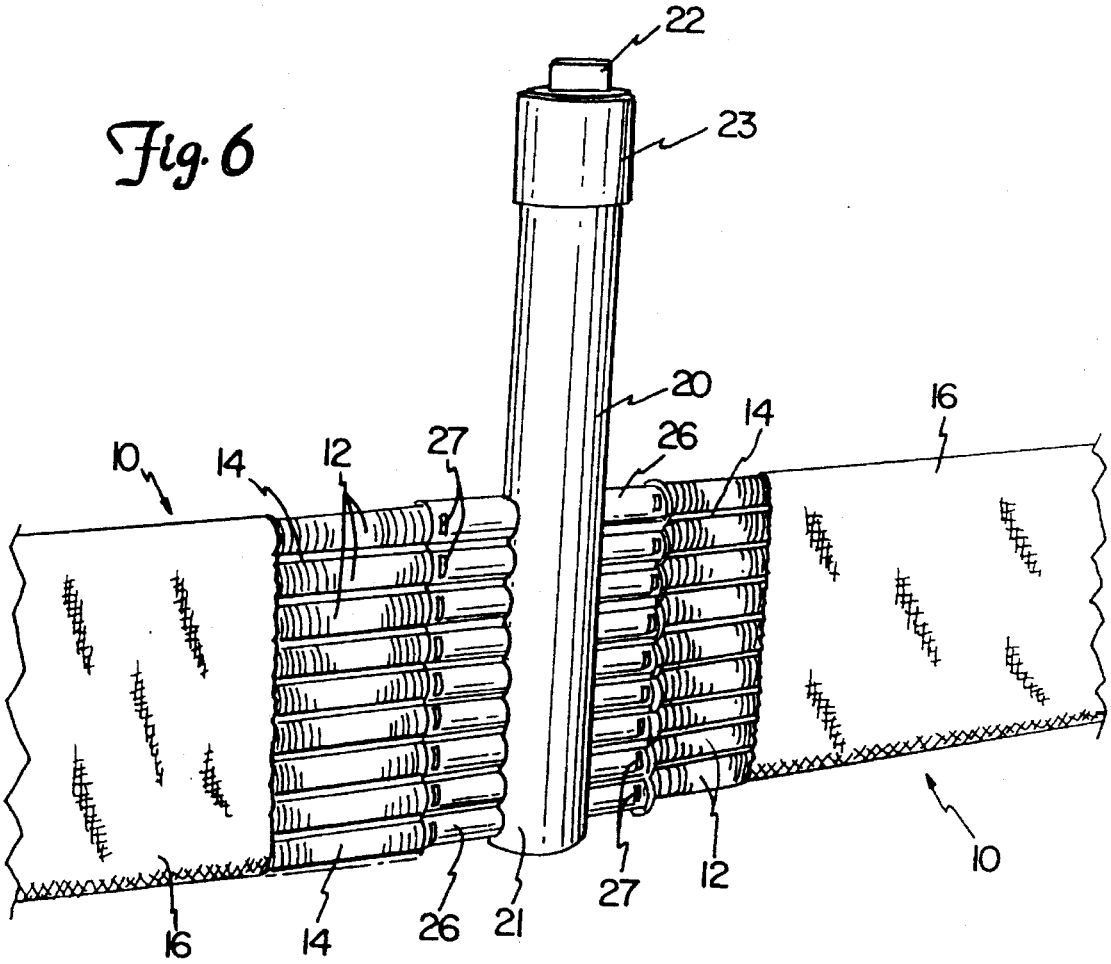
FIG. 6 is a perspective view of a junction fitting of the invention.
Figure 9:
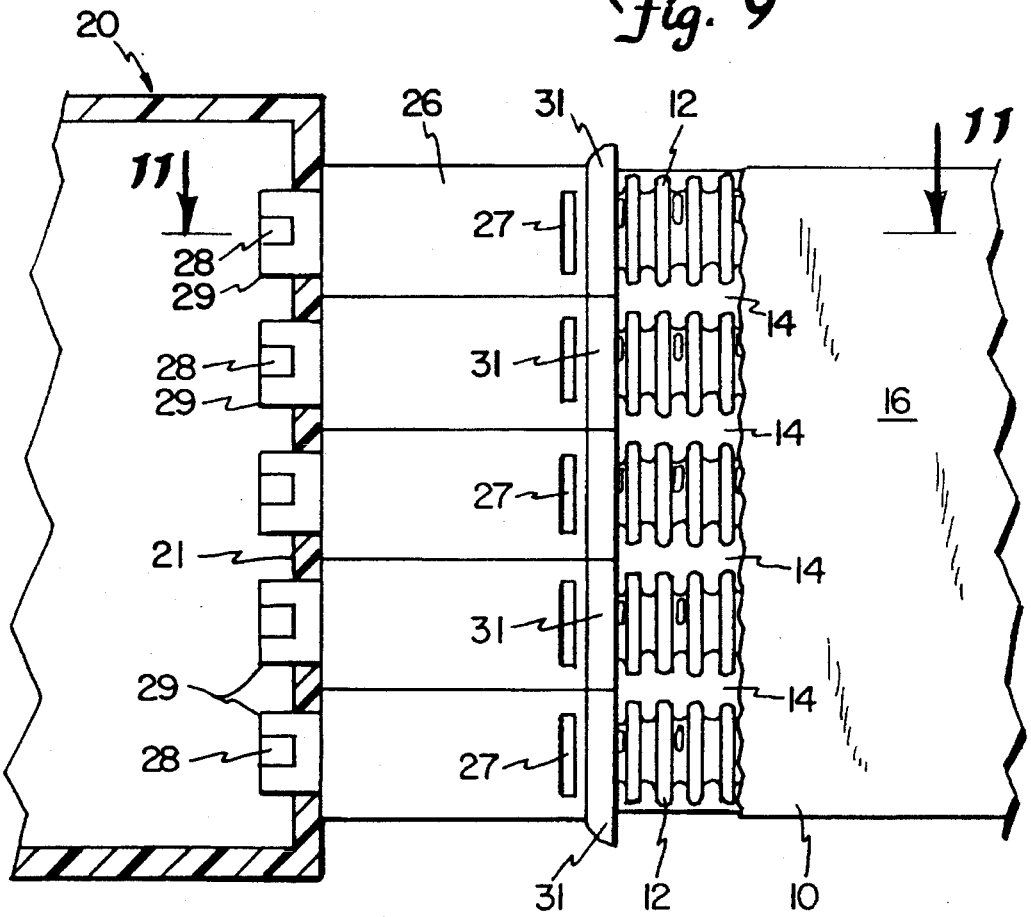
FIG. 9 is a broken-away elevational view, in partial cross-section, of a junction fitting of the invention.
Figure 10:
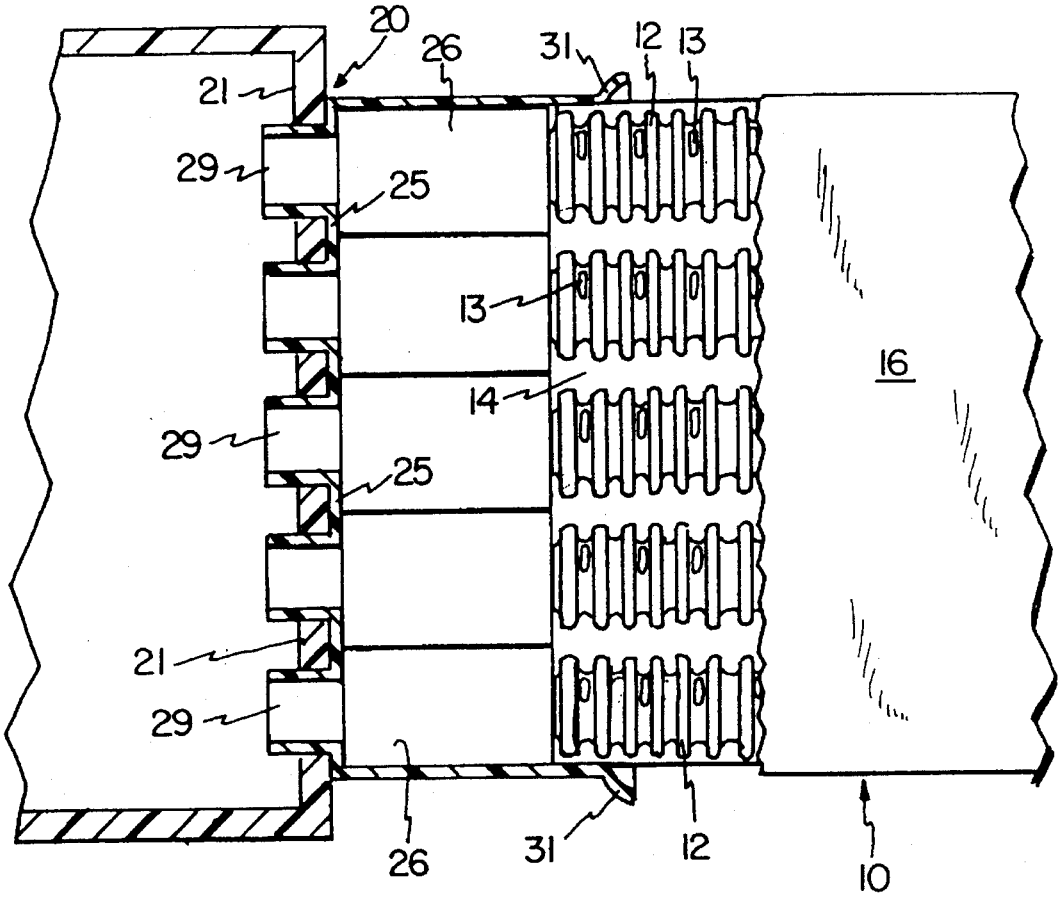
FIG. 10 is a similar view in greater partial cross-section.

FIG. 6 illustrates an embodiment similar to FIG. 5 (but absent the "el" fining and drainage tube 11). This drawing also illustrates in more detail the type of edge-type drain product described in U.S. Pat. No. 4,995,759 (which is hereby incorporated by reference). It will be understood, however, that the invention may be usable in connection with other types of edge drain products, such as that described in U.S. Pat. No. 4,904,113 (Goddard), and others. The edge-type drain tubing of the '759 patent is generally comprised of several longitudinally extending parallel thin-walled plastic (e.g., polyethylene) corrugated tubes, such tubes 12 effectively being "stacked" upon one another and joined by a web 14 to form a tubing product that is substantially taller than it is wide (preferably at least twice as tall as it is wide, and, in the embodiment shown in the drawings, about five times as tall as it is wide). Such tubes are corrugated, formed by alternating ribs and valleys, and each tube preferably has perforations (typically in the valleys) to allow water to enter and be drained away (the perforations 13 are illustrated in FIGS. 9 and 10). If the edge-type drain tubing is perforated, preferably it is also covered with a geo-textile fabric 16 to prevent the perforations in the tubing from becoming clogged with earth/backfill, and to impede the entry of foreign particles into the tubing system.

FIG. 6 illustrates the connection of the edge-type drain tubing to the junction fitting. Connection means must be provided for physically attaching the edge-type tubing to the generally vertical tube 21 of the junction fitting 20, permitting fluid (typically water) to flow frown the edge-type drainage tubing into the vertical tube 21 of the junction fitting 20 (and vice versa). In the preferred embodiment illustrated in the drawings, this connection means comprises, for each length of edge-type drain tubing 10, a tubular connector 26 (described in greater detail below). Although this tubular connector is preferred in the embodiment using edge-type drainage tubing of the type illustrated in the '759 patent, other means may also be utilized to connect the edge-type drainage tubing to the vertical tube 21 of the junction fitting 20, as may be required based on the shape and structure of the edge-type drain product being utilized. For example, though not illustrated in the drawings, another possible embodiment would include a vertical tube having one or more flat sides (i.e., either a square tube or a round tube with flat portions formed thereon) with one or more appropriately located orifices, the edge-type drainage product being welded, adhesively or mechanically secured to the flat sides of the vertical tube. Other equivalent structures could also be utilized.

Figure 7:
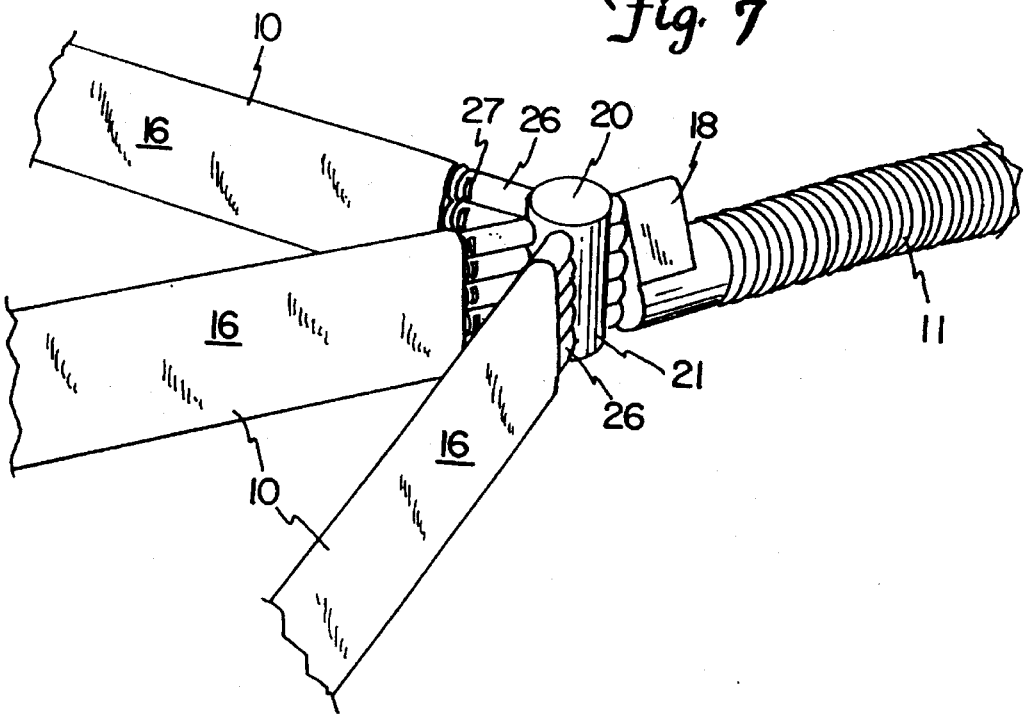
FIG. 7 is a perspective view of another junction fitting of the invention.
Figure 8:
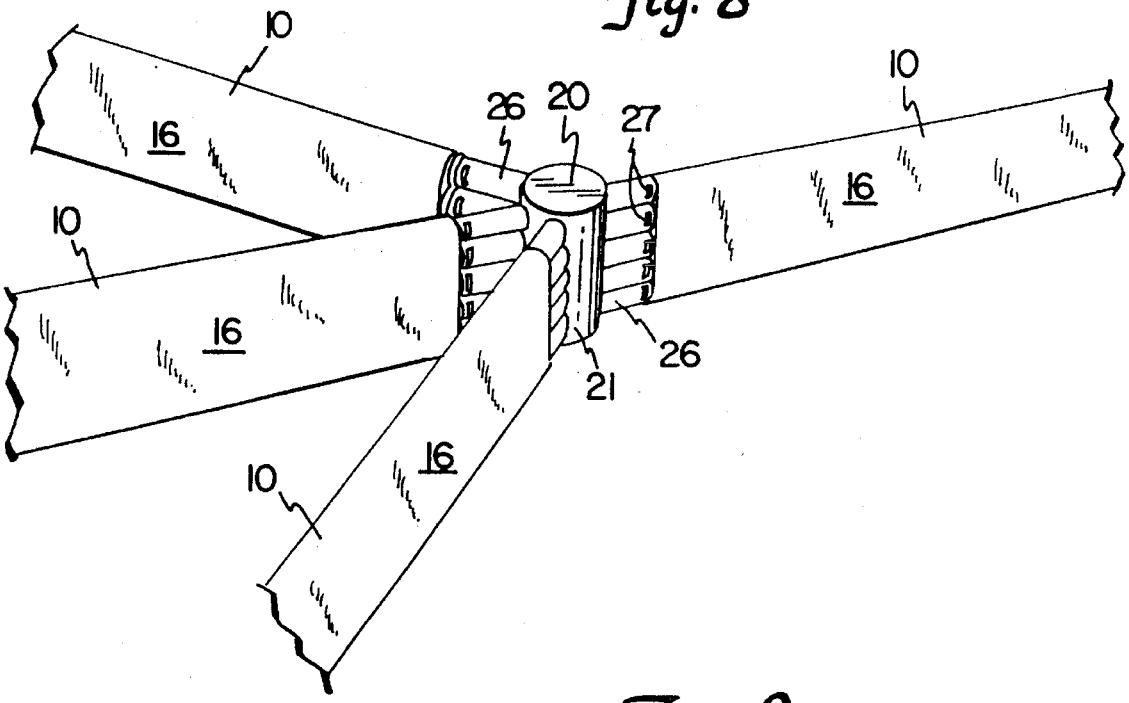
FIG. 8 is a perspective view of yet another junction fitting of the invention.
Figure 11:
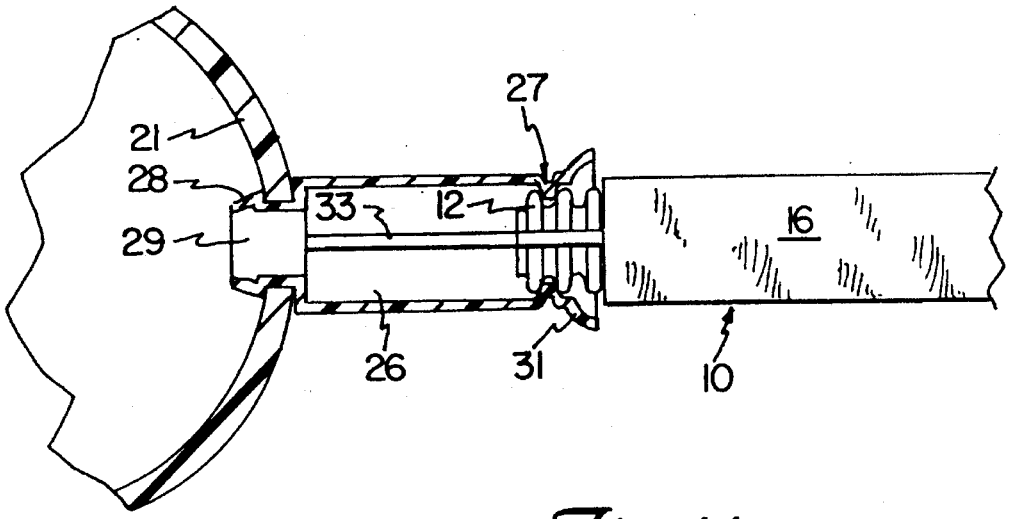
FIG. 11 is a cross-sectional view of FIG. 9, taken along line 11—11 thereof.

FIGS. 7 and 8 illustrate in greater detail the junction fittings 20 depicted schematically in FIG. 2. FIG. 7 shows the junction of three lengths of edge-type drainage tubing with a single length of round drainage tubing 11 (this junction appearing as the left-most junction in FIG. 2), and FIG. 8 shows the junction of four lengths of edge-type drain tubing 10. As illustrated in FIGS. 9–11, each length of edge-type drain tubing 10 is connected to the vertical tube 21 of the junction fitting 20 by a tubular connector 26. The tubular connector 26 in turn is made up of a series of generally tube-shaped structures having an inner end 29 received within an orifice of the vertical tube 21, and an outer end 31, which is flared outwardly slightly to receive therein the end of the edge-type drainage tubing 10. Each of the parallel tubes 12 is received in a respective tubular portion of the tubular connector 26.

Means is provided for securing the end of the edge-type drainage tubing 10 to the tubular connector 26, and for securing the tubular connector 26 to the vertical tube 21. Although such attachments may be accomplished in any suitable fashion (such as by welding (i.e., thermal melting of the plastic), adhesives, mechanical attachments, etc.), in the preferred embodiments illustrated in the drawings, these connections are made as follows. A locking protrusion 27 extends inwardly (see FIGS. 9 and 11) to engage one of the valleys of the corrugated tube 12 of the edge-type drainage product. This mechanical attachment is easily field-assembled, does not require any solvents or adhesives, yet is sturdy and effective. Although FIG. 11 shows the tube with only its first rib inserted past the protrusion 27, if desired, the tube can be pushed in further to reduce the likelihood that the tube would accidentally be jerked out of the tubular connector 26. As can be seen in FIG. 11, each of the adjacent tube portions of the tubular connector 26 has an internal slot for receiving the web 14 of the drainage tubing as the tubing is inserted into the connector 26. Other equivalent structures may be utilized to connect the end of the edge-type drain tube to the connector 26.

The opposite end of the tubular connector 26 similarly may be connected to the vertical tube 21 of the junction fitting in any suitable fashion. In the preferred embodiment illustrated in FIGS. 9–11, each of the individual tubular portions of the tubular connector 26 terminates inwardly in a smaller diameter inner end 29 which is received in a complementary orifice formed in the vertical tube 21. Locking tabs 28 are preferably provided for mechanically attaching the tubular connector 26 to the vertical tube 21.

Utilizing standard plastic pipe (e.g., a three-inch internal diameter PVC or ABS pipe having a wall thickness of approximately ¼ inch) as the vertical tube 21 of the junction fitting, a set of vertically aligned holes can be drilled in the wall of the tube 21 (the holes being, e.g., of a diameter of 1 inch). A corresponding tubular connector 26 can then be inserted into the set of holes, the locking tabs 28 mechanically securely attaching the tubular connector 26 to the vertical tube 21 to form the junction fitting 20. A length of edge drain tubing 10 can then be inserted into the open end of the tubular connector 26 to complete the connection of the edge drain tubing to the junction fitting 20. Since round pipe of the type used in this junction fitting is readily available, and round holes are easily drilled into it, the use of a single configuration of tubular connector 26 permits quick and easy fabrication of a wide variety of junction fittings 20, thus permitting use of the edge-type drainage tubing in a wide variety of circumstances and configurations without the need for expensive custom junction fittings. Although it is contemplated that the junction fittings of the invention would be fabricated in a shop and field-assembled, the simplicity and modularity of the system would even permit in-the-field fabrication using relatively simple tools, if desired.

When it is desired to connect a round drainage tube (either corrugated or smooth walled) to a junction fitting, such as in FIG. 7, a manifold-type fitting 18 or other suitable fitting is utilized to connect the round tube 11 to the vertical tube 21 of the junction fitting 20. As illustrated in FIGS. 4 and 5, however, it is also possible to readily attach a conventional "el" fitting to the bottom of the vertical tube 21, and then to connect conventional round tubing to the outlet of "el". Thus, it can be seen that utilizing a standard vertical tube 21 as a component in the junction fitting of the invention obviates the need for specialized fittings such as fitting 18 illustrated in FIG. 7.

Not only does the junction fitting system of the invention provide easy and varied fabrication of fittings for various circumstances, it also provides a junction fitting with relatively small profile in plan view. This results in the ability to install a system utilizing the junction fitting of the invention more easily and often with less equipment. For example, since prior art junction fittings are typically quite bulky, installation of a drainage system such as that illustrated in FIG. 2 would require not only a trenching machine to dig the trench for the edge-type drain (typically a 2 inch-wide trench), but also a backhoe for excavating the area in which the junction fitting lies. With the system of the invention, the intersection of the 2 inch-wide trenches effectively removes almost enough dirt to receive the vertical tube 21 of the junction fitting-typically a worker with a spade could very easily remove the inch or two of additional dirt required to receive the entire junction fitting. Thus, many installations of the drainage system of the invention could be accomplished with only a trencher, and without a backhoe, significantly reducing installation costs.

While a preferred embodiment of the present invention has been described, it should be understood that various changes, adaptations and modifications may be made therein without departing from the spirit of the invention and the scope of the appended claims.

What is claimed is:

1. A drainage tubing installation comprising:

a plurality of lengths of drainage tubing, at least two of which are each comprised of a relatively narrow, elongated edge-type drainage tubing of the type having a plurality of longitudinally extending, physically attached, parallel tubes in a generally vertically stacked and horizontally extending orientation, such edge-type drainage tubing therefore being substantially taller, in transverse cross-section, than it is wide;

at least one junction fitting for joining ends of at least three lengths of tubing, at least two of such lengths being the edge-type drainage tubing, the junction fitting comprising a central housing defined at least in part by a generally vertically oriented tube having side walls and being substantially taller than its width, the housing tube side walls having, for each edge-type drainage tubing to be connected to such fitting, a set of vertically aligned orifices spaced from one another for permitting fluid communication of such edge-type drainage tubing with the interior of the central housing, each set of orifices including an individual orifice corresponding to each of the individual parallel tubes of such edge-type drainage tubing; and connection means for connecting said ends of such lengths of edge-type drainage tubing to the central housing in registration with their respective corresponding orifices.

2. The installation of claim 1 wherein the generally vertically oriented tube defining the walls of the junction fitting housing includes a top and a bottom, one of the lengths of drainage tubing comprising a generally round tube connected to the bottom of the vertically oriented tube and extending laterally therefrom to carry away from the junction fitting water which has collected in the junction fitting.

3. The installation of claim 1 wherein the connection means comprises a plurality of longitudinally extending tubular connectors, each connector having a first end secured to the side wall of the junction fitting housing in registration with the corresponding set of orifices, and a second end attached to an end of the corresponding length of edge-type drainage tubing.

4. The installation of claim 3 wherein the first end of each such connector comprises a plurality of discrete tubes sized to be closely mate with the corresponding orifices in the fitting housing.

5. The installation of claim 4 wherein the discrete tubes include longitudinal slots for receiving therein a web joining adjacent longitudinal tubes of the edge-type drainage tubing.

6. The installation of claim 1 wherein at least one junction fitting in the installation is configured to join ends of at least three lengths of the edge-type drainage tubing.

7. The installation of claim 1 wherein the edge-type drainage tubing is at least twice as tall as it is wide.

8. A junction fitting for joining ends of two or more lengths of drainage tubing, at least one of which is a relatively narrow, elongated edge-type drainage tubing of the type which, in transverse cross-section, is substantially taller than it is wide, the junction fitting comprising a central housing having generally vertically oriented side walls having, for each edge-type drainage tubing to be connected to such fitting, one or more orifices for permitting fluid communication of such drainage tubing with the interior of the central housing, and means for connecting the edge-type drainage tubing to the central housing in registration with the orifice(s).

9. The junction fitting of claim 8 wherein the generally vertically oriented tube defining the walls of the junction fitting housing includes a top and a bottom, one of the lengths of drainage tubing comprising a generally round tube connected to the bottom of the vertically oriented tube and extending laterally therefrom to carry away from the junction fitting water which has collected in the junction fitting.

10. The junction fitting of claim 8 wherein the connection means comprises a plurality of longitudinally extending tubular connectors, each connector having a first end secured to the side wall of the junction fitting housing in registration with the corresponding orifices, and a second end attached to an end of the corresponding length of edge-type drainage tubing.

11. The junction fitting of claim 10 wherein the first end of each such connector comprises a plurality of discrete tubes sized to be closely mate with corresponding orifices in the fitting housing.

12. The junction fitting of claim 8 wherein the fitting is configured to join ends of at least three lengths of the edge-type drainage tubing.

13. A drainage tubing installation comprising:

a plurality of lengths of drainage tubing, at least two of which are each comprised of a relatively narrow, elongated edge-type drainage tubing of the type which, in transverse cross-section, is substantially taller than it is wide;

at least one junction fitting joining ends of three or more lengths of drainage tubing in fluid communication, at least two of such lengths being of the edge-type drainage tubing, the junction fitting comprising a central housing defined at least in part by a generally vertically oriented tube having side walls and being substantially taller than its width, the side walls having, for each edge-type drainage tubing connected to such fitting, one or more orifices aligned with the corresponding edge-type drainage tubing to permit fluid communication of such drainage tubing with the interior of the central housing, and;

connection means for connecting the edge-type drainage tubing to the central housing in registration with the orifices.

14. The installation of claim 13 wherein the generally vertically oriented tube defining the walls of the junction fitting housing includes a top and a bottom, one of the lengths of drainage tubing comprising a generally round tube connected to the bottom of the vertically oriented tube and extending laterally therefrom to carry away from the junction fitting water which has collected in the junction fitting.

15. The installation of claim 14 wherein the round drainage tube connected to the bottom of the vertically oriented tube is non-perforated.

16. The installation of claim 13 wherein the connection means comprises a plurality of longitudinally extending tubular connectors, each connector having a first end secured to the side wall of the junction fitting housing in registration with the corresponding set of orifices, and a second end attached to an end of the corresponding length of edge-type drainage tubing.

17. The installation of claim 13 wherein the connection means comprises a weld.

18. The installation of claim 13 wherein the connection means comprises a mechanical attachment.

19. The installation of claim 13 wherein the connection means comprises an adhesive.

20. The installation of claim 1 wherein at least one junction fitting in the installation is configured to join ends of at least three lengths of the edge-type drainage tubing.

21. A junction fitting for joining ends of two or more lengths of drainage tubing, at least one of which is a relatively narrow, elongated edge-type drainage tubing of the type which is comprised of a plurality of longitudinally extending, physically attached, parallel tubes in a generally vertically stacked and horizontally extending orientation, the edge-type drainage tubing therefore being substantially taller, in transverse cross-section, than it is wide, the junction fitting comprising:

a central housing defined at least in part by a generally vertically oriented tube having side walls and being substantially taller than its width, the housing side walls having, for each edge-type drainage tubing to be connected to such fitting, a set of vertically aligned orifices spaced from one another for permitting fluid communication of such edge-type drainage tubing with the interior of the central housing, each set of orifices including an individual orifice corresponding to each of the individual parallel tubes of such edge-type drainage tubing; and means for connecting the edge-type drainage tubing to the central housing in registration with the corresponding orifices.

22. A drainage tubing installation comprising:

two lengths of drainage tubing, each of which is comprised of a relatively narrow, elongated edge-type drainage tubing of the type which, in transverse cross-section, is substantially taller than it is wide;

a junction fitting for joining one end of each of the two lengths of edge-type drainage tubing, the junction fitting comprising a central housing defined at least in part by a generally vertically oriented tube having side walls and being substantially taller than its width, the housing tube side walls having, for each edge-type drainage tubing to be connected to such fitting, an orifice for permitting fluid communication of such edge-type drainage tubing with the interior of the central housing; and connection means for connecting said ends of such lengths of edge-type drainage tubing to the central housing in registration with their respective corresponding orifices;

the vertically oriented tube extending vertically upwardly from the orifices, and including a removable cap sealing an upper end of the vertically oriented tube.

23. The drainage tubing installation of claim 21 wherein the vertically oriented tube is of a height taller than twice the height of the edge-type drainage tubing, the vertically oriented tube including two or more sets of orifices vertically spaced from one another to facilitate connection of two or more lengths of edge-type drainage tubing which are vertically spaced from one another.

24. The drainage tubing installation of claim 21 wherein the edge-type drainage tubing is of the type having a plurality of longitudinally extending, physically attached, parallel tubes in a generally vertically stacked and horizontally extending orientation, the vertically oriented tube including, for each such length of edge-type drainage tubing connected to the fitting, a set of orifices that corresponds to each of the individual parallel tubes of such edge-type drainage tubing.

* * * * *